United States Patent [19]

Althen et al.

[11] 4,197,680

[45] Apr. 15, 1980

[54] PRECISION HONING MANDREL

[75] Inventors: Wayne W. Althen; Harold T. Rutter, both of St. Louis County, Mo.

[73] Assignee: Sunnen Products Company, St. Louis, Mo.

[21] Appl. No.: 916,518

[22] Filed: Jun. 19, 1978

[51] Int. Cl.[2] ..... B24B 33/02

[52] U.S. Cl. ..... 51/343; 51/350; 51/380; 408/232

[58] Field of Search ..... 51/241 VS, 241 A, 338, 51/339, 340, 342, 343, 344, 345, 346, 350, 364, 370, 375, 380, 395; 408/200, 201, 202, 203, 231, 232, 238–240

[56] References Cited

U.S. PATENT DOCUMENTS

| | | | |
|---|---|---|---|
| 1,789,080 | 1/1931 | Neldner | 51/241 VS |
| 1,873,177 | 8/1932 | Beard | 408/200 |
| 1,910,658 | 5/1933 | Tydeman | 51/339 |
| 1,950,522 | 3/1934 | Seelert | 51/241 VS X |
| 2,063,931 | 12/1936 | Hutto | 51/342 |
| 2,332,463 | 10/1943 | Palotce | 51/339 |
| 2,419,297 | 4/1947 | Steigerwald | 51/345 |
| 2,694,277 | 11/1954 | Speck | 51/346 |
| 2,977,727 | 4/1961 | Gray et al. | 51/241 VS |
| 3,589,082 | 6/1971 | Sodayko | 51/340 |
| 3,717,956 | 2/1973 | Keatts | 51/339 X |
| 4,065,881 | 1/1978 | Gillette | 51/344 X |

*Primary Examiner*—Gary L. Smith

*Assistant Examiner*—Robert P. Olszewski

*Attorney, Agent, or Firm*—Charles B. Haverstock

[57] ABSTRACT

A precision honing mandrel including a tubular honing member having a helical, straight or other shaped groove therethrough, a substantially cylindrical outer surface, a tapered inner surface, and a layer of a relatively hard wear resistant abrasive substance applied to the cylindrical outer surface, an arbor for mounting said honing member including a first arbor portion for mounting on a honing machine, and a tapered second arbor portion for receiving said honing member thereon, a guide member mounted on the opposite side of the honing member from the first arbor portion, said guide member having an end surface in abutment with one end of the honing member and a tapered inner surface for cooperating with the tapered arbor portion, a keyway formed in said tapered arbor portion and aligned slots in the honing member and in the guide member adjacent the abutting ends thereof, a key member positioned to cooperate with said aligned slots and with said keyway to prevent relative rotational movement between the honing member, the guide member and the arbor, and an adjustment member having a first portion threadedly engageable with said arbor and a second portion engageable with said guide member, adjustment of said adjustment member adjusting the axial portion of said honing member on said tapered second arbor portion.

16 Claims, 5 Drawing Figures

PRECISION HONING MANDREL

Many honing mandrels and other honing devices have been constructed and used in the past. For the most part, the known mandrel constructions have used honing stones and like members which are adjustable radially thereon during a honing operation in order to maintain them engaged with the work as a surface on the work is enlarged and as the stones wear. Typical of such honing mandrels are the mandrels disclosed in Sunnen U.S. Pat. Nos. 2,532,682, dated Dec. 5, 1950; 2,580,327, dated Dec. 25, 1951; 2,580,328, dated Dec. 25, 1951; 2,799,127, dated July 16, 1957; 2,815,615, dated Dec. 10, 1957 and 3,800,482, dated Apr. 2, 1974. Mandrels of the types disclosed in these patents are well known and widely used, and the present construction is not designed or constructed to replace them. Instead, the present mandrel construction is designed to be moved once, and in some cases more than once, through the work surface, to remove material and to accurately size the surface and improve the surface characteristics thereof. It is not the intention of the present mandrel device, however, to be adjustable during a honing operation, and it is contemplated that the present construction will use relatively hard wear resistant abrasive substances such as diamond particles, cubic boron nitride and like substances which are known to be relatively expensive but also undergo relatively little wear even after repeated use. The subject mandrel construction is designed to be adjustable within limits to compensate for wear and to a limited degree to be adjustable as to size also, but not to be adjustable during honing operations. The advantages of being able to finish and accurately size a work surface during a single pass of the subject mandrel through the work represents an important advancement in the honing art.

It is therefore a principal object of the present invention to teach the construction and operation of a honing mandrel which is primarily for very accurately finishing and sizing work surfaces.

Another object is to provide a honing mandrel which has a relatively long life and which is primarily used by passing it once, and in some cases more than once, through the work.

Another object is to teach the construction and operation of a relatively simple mandrel construction which does not ordinarily require adjustment during operation thereof but which can be adjusted within limits to compensate for wear and to provide limited size adjustment.

Another object is to provide a mandrel construction having improved means associated therewith for the circulation of honing oils and other lubricants and coolants.

Another object is to teach the construction and operation of a mandrel which is relatively easy to assemble and adjust.

Another object is to provide a mandrel which is relatively safe to use and is constructed so as to minimize the possibility for binding or jamming.

Another object is to enable the construction of more accurately sized surfaces produced during honing or abrading operations.

Another object is to provide means to prevent slippage between the parts of a honing mandrel.

Another object is to provide a mandrel construction that can be made to take on load gradually and uniformly.

Another object is to provide a mandrel wherein the wear is gradual and is relatively uniformly distributed over a relatively large area.

Another object is to enable the more accurate honing of cylindrical surfaces even by persons having relatively little skill and training.

These and other objects and advantages of the present invention will become apparent after considering the following detailed specification in association with the accompanying drawing which discloses the subject mandrel construction as well as several mandrel constructions developed during the evolution thereof, and wherein.

Figures 1, 2, 3, 4, 5:
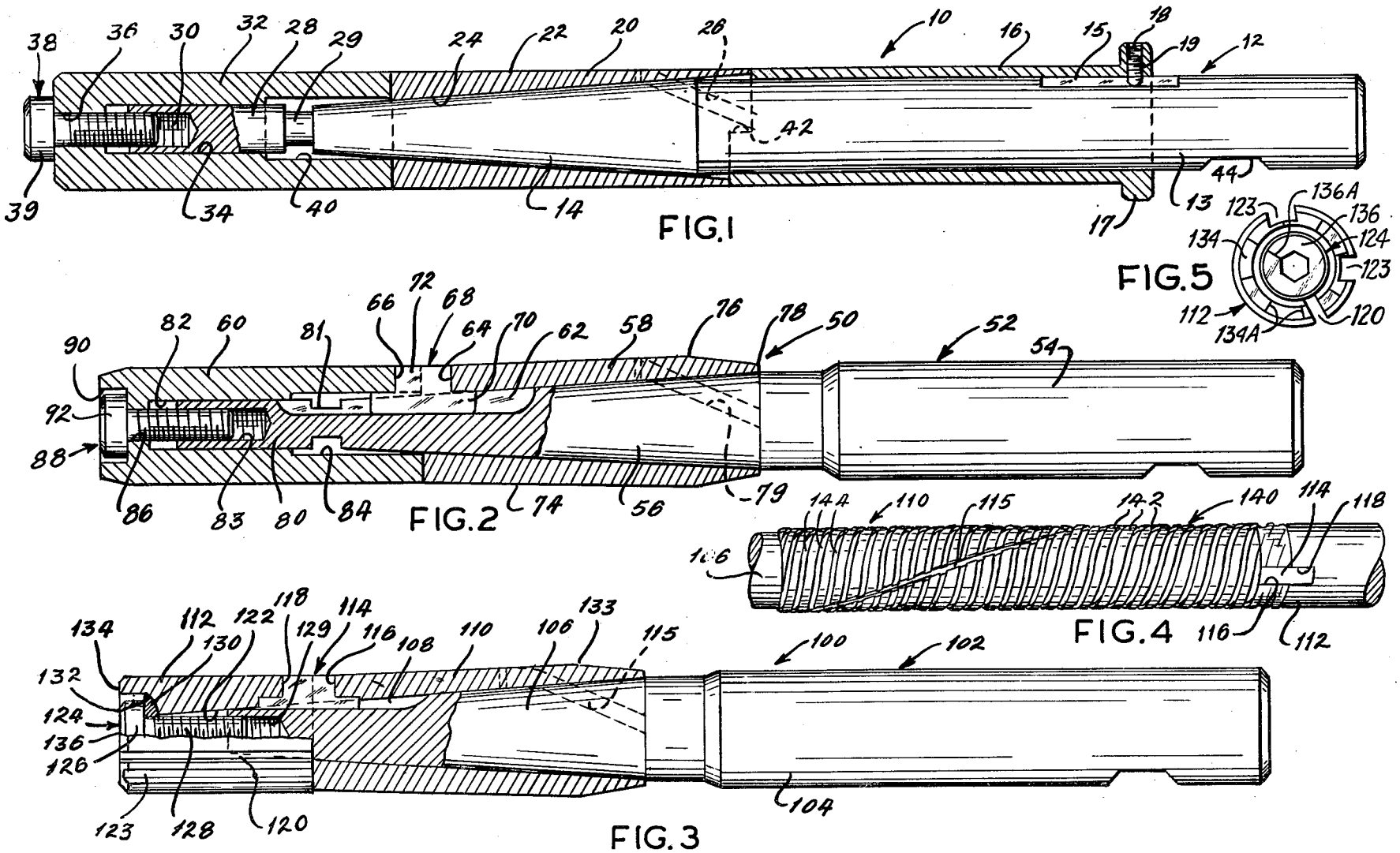
FIG. 1 is a cross-sectional view through a forerunner mandrel construction to the present mandrel construction.
FIG. 2 is a cross-sectional view through another mandrel from which the subject improved mandrel evolved.
FIG. 3 is a cross-sectional view through a preferred embodiment of the subject mandrel construction.
FIG. 4 is a side elevational view of a honing member of the type used on the subject mandrels, said member being shown on an arbor; and, FIG. 5 is a left end view of the device shown in FIG. 4.

Referring to the drawing more particularly by reference numbers, number 10 in FIG. 1 refers to a honing mandrel of a type which is a forerunner to the subject mandrel but embodies some but not all of the teachings thereof. The mandrel 10 includes an arbor 12 with a first portion 13 which is shown cylindrical for mounting on a honing machine, and a second tapered portion 14. The taper of the portion 14 is shown somewhat exaggerated for clarity. The arbor portion 13 has an elongated groove 15 formed therein as shown. A tubular sleeve 16 is positioned on the arbor 12 and has annular flange 17 on one end. The flange 17 has a radial threaded bore 18 which receives a threaded set screw 19 which is used to lock the sleeve in place on the arbor 12.

A honing member 20, having a substantially cylindrical outer surface 22 and a tapered inner surface 24, is mounted on the tapered arbor portion 14 such that the tapered surfaces 14 and 24 of the honing member 20 and of the arbor are in surface-to-surface contact. The honing member 20 also has a helical, straight, or other shaped groove 26 that extends completely through the member 20 from end-to-end therealong. The groove 26 is shown as helical for illustrative purposes and provides means along the honing member for the circulation of honing oil or coolant during a honing operation, and the groove 26 also enables the member 20 to be adjusted on the tapered arbor portion 14 by enabling the member 20 to move axially relative thereto so as to change the diameter of the outer surface thereof. This is important as a means, within limits, to adjust the honing diameter. The arbor 12 also has an endwardly extending cylindrical portion 28 which has a threaded bore 30 extending therein from its free end. The cylindrical portion 28 is connected to the tapered arbor portion 14 by a reduced diameter portion 29, and the cylindrical arbor portion 28 substantially increases the overall length of the mandrel 10 which is not always desirable.

A pilot member 32, having a bore 34 formed therein, is slidably positioned on the arbor end portion 28. The pilot member 32 also has a smaller diameter bore 36 which extends through the free end thereof, and the bore 36 receives a threaded adjustment member 38 which has a head portion 39 that engages the end surface of the pilot member 32, and the member 38 is threadedly engaged with the threaded bore 30 in the cylindrical arbor member 28. The pilot member 32 also has a somewhat larger diameter bore portion 40 which is aligned axially with the bores 34 and 36 and extends from the end of the pilot member 32 that abuts the honing member 20. The diameter of the bore portion 40 is selected to be large enough so that axial movements of the pilot member 32 during adjustment will not cause the pilot member 32 to rub on or otherwise engage the tapered arbor position 14. These features also contribute to the overall length of the mandrel 10.

In the construction as shown in FIG. 1, the end of the tubular sleeve 16 that is adjacent to the honing member 20 is notched as shown at 42, and the honing member 20 is similarly notched so that when the members are abutting they cannot move rotationally relative to each other. This is done to also minimize the possibility of these members rotating on the arbor under load. In order to adjust the construction 10 shown in FIG. 1 the set screw 19 is loosened so that the sleeve can move axially but not rotationally on the arbor portion 13. The threaded member 38 is then rotated in order to move the pilot member 32 and the honing member 20 axially on the honing arbor 12 toward the sleeve 16. The further the adjustment is made the more the honing member 20 will move up the tapered arbor portion 14 and hence the greater will be the honing diameter. In the construction as shown in FIG. 1, the unstressed diameter of the honing member 20 is slightly larger than the diameter of the pilot member 32 and of the tubular sleeve 16. This is so that the pilot member 32 and the tubular sleeve 16 will both act as guides or pilots during a honing operation while permitting the honing member, which has the slightly larger diameter, to engage and hone the work surface. While earlier embodiments used honing members with cylindrical outer surfaces it has been found and is preferred, though not essential, that the outer abrasive surface 22 of the honing member 20 have a slight increase in size from the end adjacent to the pilot or guide member 32 to near to the opposite end that is adjacent to the tubular sleeve 16. It is preferred that the diameter of the honing member 20 reach a maximum a short distance from the member 16, and the maximum diameter of the member 20 should be the desired final diameter to be honed. The reasons for having a slight taper in the outer surface of the member 20 is to enable the member to come under load gradually without having the full length of the honing member honing with the same force at any one time and without having the leading edge portion do most of the work and undergo most of the wear, and also having a slight taper distributes the wear over a relatively larger area. These are important advantages when one considers that the subject mandrel is designed primarily to move through the work one time, and perhaps several times in some cases, to complete its honing operation. In the construction of FIG. 1 there is no provision to prevent relative rotational movement between the pilot member 32 and the honing member 20, and the provision of the sleeve 16 increases the cost and requires additional adjustment procedure to position it and lock it in place on the arbor. The length of the FIG. 1 construction also makes it somewhat vulnerable to damage by rough handling and to damage during operation. Also in the FIG. 1 construction the arbor portion 13 is shown having a flat 44 which is provided for locking the mandrel in position on a honing machine.

The construction 50 shown in FIG. 2 has some of the same features as the construction of FIG. 1 including having a somewhat modified type arbor 52 which includes a cylindrical portion 54 for mounting in a honing machine and a reduced diameter tapered portion 56 which is the portion on which honing member 58 is mounted. In the construction 50, the tapered portion 56 is provided with an axially extending keyway 62, and the members 58 and 60 are provided with slots 64 and 66 respectively in their adjacent ends. The combined length of the slots 64 and 66 is less than the length of the keyway 62. A T-shaped key member 68 having a cross portion 70 and a stem portion 72, is positioned with its cross portion 70 in the keyway 62 and the stem portion 72 positioned in the aligned slots 64 and 66 as clearly shown. With the key installed as shown there can be no relative rotational movement between the members 56, 58 and 60 but there can be axial movement of the members 58 and 60 relative to the tapered arbor portion 56 to enable adjustment. Also in the construction shown in FIG. 2 the outer surface 74 of the honing member 58 is shown being gradually tapered from the end adjacent to the pilot member 60 to its largest diameter near to the opposite end at 76. The taper is shown greatly exaggerated for clarity, while in an actual device the taper is relatively slight. The diameter of the member 58 at the high spot 76 is the desired final honing diameter. The diameter of the outer surface 74 becomes smaller toward the end 78. The slight taper of the surface 74 enables the honing member 58 to gradually assume load during a honing operation and in some situations the surface 74 may be cylindrical.

The honing member 58 like the honing member 20 above has a groove 79 (FIG. 2), which is shown as being helical but which can have other shapes as well. Only a portion of this groove 79 is shown in FIG. 2 although the groove 79 extends from end-to-end and expands during adjustment to increase the diameter of the member 58 as it is forced up the tapered arbor member 56.

The arbor 52 has an endwardly extending cylindrical portion 80 which is attached to the smaller diameter end of the tapered portion 56, being separated therefrom by a still smaller diameter arbor portion 81, and the portion 80 is positioned in bore 82 in the pilot member 60. The portion 80 has a threaded bore 83 formed therein as shown. The pilot member 60 also has a larger diameter bore portion 84 which enables it to clear the smaller end of the tapered portion 56 for adjustment purposes, and the pilot 60 has a smaller diameter bore portion 86 through which threaded adjustment member 88 extends for cooperation with the threaded bore 83. The pilot portion 60 also has another bore portion 90 which receives the head portion 92 of the threaded adjustment member 88.

The honing member 58 is preferably formed of a relatively hard but somewhat resilient material such that it will expand during adjustment but will also restore itself to its original unstressed condition when it is removed from the arbor 52. In the drawings, the taper of the arbor portion 56 (and 14) is shown exaggerated for clarity and ease of understanding. It should be recognized, however, that the embodiments of FIGS. 1 and 2 are both used for the same or similar purposes, namely, to remove relatively small amounts of material from a cylindrical work surface in order to bring the diameter of the work surface to some precise final diameter, and to do so preferably during a single pass of the mandrel through the work. It should also be noted that the mandrel 50 in FIG. 2 does not require a sleeve member similar to the sleeve member 16 shown in FIG. 1 and this is an advantage since it reduces the cost and reduces the steps that are necessary to assemble and adjust the device. However, the construction 50 shown in FIG. 2 must be made to have about the same length as the construction 10 and is also relatively easy to damage for many of the same reasons already discussed. For these and other reasons the embodiments of FIGS. 1 and 2 have enjoyed limited usefulness.

FIG. 3 shows an improved mandrel embodiment 100 which incorporates the features of the present invention. The mandrel 100 has been commercially successful and has overcome the shortcomings and disadvantages of prior constructions including those constructions shown in FIGS. 1 and 2. The mandrel 100 includes an arbor 102 with a cylindrical portion 104 for mounting it on a honing machine. The arbor 102 also has a tapered portion 106 with elongated keyway 108 formed therein. The construction 100 has a honing member 110 that may be somewhat similar to the members 20 and 58 and it has a pilot member 112. The honing member 110 and the pilot member 112 are held against relative rotation by means of the key 114 which cooperates with end slots 116 and 118 in the members 110 and 112 respectively and with the keyway 108 in the tapered arbor portion 106. The honing member 110 also has a full length helical or other shaped slot or groove 115 therethrough.

In the construction shown in FIG. 3 the pilot member 112 has an axial slot 120 therethrough which extends the length thereof and a plurality of other slots or grooves 123 (only one being shown) formed therein. The pilot member 112 also has a tapered inner surface 122 which cooperates with the tapered arbor portion 106. These are important differences from the constructions shown in FIGS. 1 and 2 wherein the pilot members cooperate with a cylindrical extension of the arbor. This means that the honing and adjustment portions of the construction shown in FIG. 3 can be made to be relatively much shorter and stronger for the same length honing member than can the constructions of FIGS. 1 and 2 while at the same time providing means to make axial adjustment of the honing member 110 as required. Also the construction shown in FIG. 3 has a threaded adjustment member 124 which includes a head portion 126 and a threaded portion 128 which cooperates with a threaded bore 129 formed in the end of the tapered arbor portion 106. The construction 100 has an annular washer member 130 which is positioned in socket 132 formed in the pilot member 112. The washer 130 cooperates with the head portion 126 of the adjustment member 124 and with the pilot member 112 to minimize binding of the adjustment member 124 thereon during adjustment and to accommodate expansion of the pilot member 112. Also with the construction of FIG. 3 the pilot member 112, like the honing member 110, must be able to increase in size during adjustment, and to facilitate this the slot 120 and the grooves 123 are provided. The grooves 123 are at spaced locations around the pilot member 112 to facilitate expansion thereof during adjustment. Note also that with the construction of FIG. 3 there is no relatively thin arbor portion such as the arbor portions 29 and 81 in FIGS. 1 and 2.

It is important to note that with the construction 100 of FIG. 3 that when adjustments are made by adjusting the member 124, that the difference between the diameter of the high spot or crown 133 on the member 110 and the pilot member 112 remains the same in all positions which is not true of the constructions of FIGS. 1 and 2 wherein the diameter of the pilot member does not change during adjustment. This has been found to be an important factor to maintaining the honing accuracy of the device.

The end surface 134 of the pilot member 112 and the end surface 136 of the adjustment member 124 may have suitable indicator lines or graduated scales thereon such as lines 134A and 136A (FIG. 5) to show the relative positions of the members and to provide means to determine the amount of adjustment that is made. This can be very helpful when making adjustments since the graduated scales can be calibrated to provide a very precise relationship of honing diameter in terms of rotation of the adjustment member 124. It has been found that adjustment means such as described also provide a very accurate way to increase the honing diameter to compensate foı wear and to initially set the mandrel.

In an actual device it has also been found that some limited adjustment of the honing diameter can be made. This usually ranges between a few thousanths of an inch in either direction from some desired dimension. If too much adjustment is made above the desired dimension, however, the honing member may not be able to return to its initial unstressed condition and this may be undesirable.

FIG. 4 shows a side view of the honing member such as the honing member 110 of the type employed in the present device. The member 110 is shown having a groove 115 such as the grooves 26 and 79 therethrough extending from end-to-end. The outer surface 140 of the member is coated or plated with an abrasive layer 142 such as with particles of diamonds or cubic boron nitride, and the outer surface is also provided with another helical groove 144. The groove 144 is relatively shallow and is included for lubricating purposes and to reduce the amount of total surface area that must be plated. This substantially reduces the cost. The size or width and spacing of the convolutions or the groove 144 can be varied as desired and in some constructions they can also be plated with abrasive where the cost factor is not as important. Note also that the end of the member 110 has a notch similar to the notch 116 formed therein.

Thus there has been shown and described a novel honing mandrel construction which fulfills all of the objects and advantages sought therefor. It will be apparent to those skilled in the art, however, that many changes, modifications, variations and other uses and applications for the subject mandrel are possible, and all such changes, modifications, variations and other uses and applications which do not depart from the spirit and scope of the invention are deemed to be covered by the invention which is limited only by the claims which follow.

What is claimed is:

1. A honing mandrel comprising an elongated arbor having a first portion for mounting on a honing machine and a second portion axially aligned with the first portion, said second portion having a tapered outer surface over a portion of a length thereof, a tubular honing member having an inner and an outer surface, the inner surface being axially tapered for cooperating with the tapered outer surface of the second arbor portion, means forming a layer of a relatively hard abrasive substance of the outer surface of the honing member, a groove through the honing member extending from one end thereof to the other, a pilot member mounted on the second arbor portion on the opposite side of the honing member from the first arbor portion and extending from the honing member adjacent one end thereof to beyond the end of the second arbor portion, said pilot member having an axial slot therethrough extending the length thereof and a tapered inner surface to cooperate with the tapered arbor portion, and a socket formed extending into the end thereof opposite from the honing member, and means threadedly engageable with the arbor and engageable with the socket in the pilot member for adjusting the axial position of said pilot member and of the honing member on the second arbor portion, said threaded means including a threaded bore extending into the second arbor portion and a threaded member having a first portion threadedly engageable with the threaded bore and a head portion engageable with the socket in the pilot member.

2. The mandrel defined in claim 1 including means to prevent relative rotational movement between the arbor, the honing member, and the pilot member.

3. The honing member defined in claim 2 wherein said means to prevent relative movement include a keyway in the second arbor portion, and aligned and registrable slots formed in the adjacent abutting ends of the honing member and the pilot member, and a key member cooperatively engageble with said keyway and with said aligned registered slots.

4. The honing mandrel defined in claim 1 wherein said honing member is tubular in shape and has axially tapered inner and outer surface portions.

5. The honing mandrel defined in claim 1 including means to indicate different positions of adjustment of the adjustment means relative to the pilot member.

6. The honing mandrel defined in claim 1 including a helical surface groove formed in the outer surface of the honing member.

7. The honing mandrel defined in claim 1 wherein the outer surface of the tubular honing member is tapered over a portion thereof.

8. The honing mandrel defined in claim 1 wherein the outer surface of the tubular honing member has a portion thereof coated with a layer including particles of a relatively hard material.

9. The honing mandrel defined in claim 8 wherein the particles in said layer are diamond particles.

10. The honing mandrel defined in claim 8 wherein the particles in said layer are particles of cubic boron nitride.

11. A honing mandrel comprising an elongated arbor having a first portion for mounting on a honing machine and a second portion integral with the first portion and axially aligned therewith, said second portion having a tapered outer surface extending from a larger diameter end adjacent to the first arbor portion to a smaller diameter opposite free end, a threaded bore extending into the second arbor portion from the free end thereof, a honing member having a substantially cylindrical outer surface and a tapered inner surface for cooperating with the tapered outer surface of the second arbor portion, means forming a helical groove through the honing member extending from end-to-end thereof, a layer including particles of a relatively hard wear resistant substance on the outer surface of the honing member, a pilot member having a tapered inner surface for cooperating with the tapered outer surface of the second arbor portion and an end-to-end extending groove therethrough, said pilot member extending beyond the end of the second arbor portion and having a socket formed in the end thereof, an annular washer in the socket, said pilot member being mounted on said second arbor portion in position abutting one end of the honing member, and means for simultaneously adjusting the axial position of the pilot member and of the honing member on the second arbor portion, said last named means including a member threadedly engageable with the threaded bore in the arbor and a head portion engageable with the annular washer in the socket.

12. The honing mandrel defined in claim 11 including means to prevent relative rotational movement between the honing member, the pilot member and the arbor.

13. The honing mandrel defined in claim 12 wherein the pilot member has an outer surface having a plurality of axially extending surface grooves formed therein to facilitate expansion in the diameter thereof during axial adjustment on the second arbor portion.

14. The honing mandrel defined in claim 11 where the outer surface of the honing member has relatively shallow groove means formed therein extending from end-to-end therealong.

15. The honing mandrel defined in claim 11 including cooperating indicator means on the pilot member and on the adjustment means calibrated to indicate changes in the diameter of the honing member in terms of movement of the threaded adjustment member relative to the arbor.

16. The honing mandrel defined in claim 11 wherein the honing member is constructed of a somewhat resilient metallic material capable of limited expansion from its unstressed condition to increase the honing diameter thereof without losing its ability to return to its original unstressed condition.

* * * * *

UNITED STATES PATENT OFFICE

CERTIFICATE OF CORRECTION

Patent No. 4,197,680 Dated April 15, 1980

Inventor(s) Wayne W. Althen & Harold T. Rutter

It is certified that error appears in the above-identified patent and that said Letters Patent are hereby corrected as shown below:

Abstract, line 25 "portion" should be

---position---

Column 3, line 12 "position" should be

---portion---

Signed and Sealed this

*Twenty-fourth* Day of *June 1980*

[SEAL]

*Attest:*

SIDNEY A. DIAMOND

*Attesting Officer*

*Commissioner of Patents and Trademarks*